US007872625B2

(12) United States Patent
Hirakawa et al.

(10) Patent No.: US 7,872,625 B2
(45) Date of Patent: Jan. 18, 2011

(54) LIQUID-CRYSTAL DISPLAY APPARATUS AND THREE-PANEL LIQUID-CRYSTAL DISPLAY PROJECTOR

(75) Inventors: Takashi Hirakawa, Kanagawa (JP); Hiroyuki Yoshine, Kanagawa (JP)

(73) Assignee: Sony Corporation, Tokyo (JP)

( * ) Notice: Subject to any disclaimer, the term of this patent is extended or adjusted under 35 U.S.C. 154(b) by 1990 days.

(21) Appl. No.: 10/811,246

(22) Filed: Mar. 29, 2004

(65) Prior Publication Data

US 2004/0246217 A1 Dec. 9, 2004

Related U.S. Application Data

(63) Continuation of application No. 09/417,714, filed on Oct. 13, 1999, now abandoned.

(30) Foreign Application Priority Data

Oct. 14, 1998 (JP) ..... P10-292280

(51) Int. Cl.
*G09G 3/36* (2006.01)

(52) U.S. Cl. ..... 345/88; 345/204

(58) Field of Classification Search ..... 345/97–104, 345/204; 348/189–191, 745–747, 658, 751, 348/761, 766, 790
See application file for complete search history.

(56) References Cited

U.S. PATENT DOCUMENTS 4,319,237 A * 3/1982 Matsuo et al. ..... 345/101
5,831,605 A * 11/1998 Yasui et al. ..... 345/211
5,841,410 A * 11/1998 Oda et al. ..... 345/58
5,929,847 A * 7/1999 Yanagi et al. ..... 345/204
6,118,421 A * 9/2000 Kawaguchi et al. ..... 345/89

FOREIGN PATENT DOCUMENTS

| | | | |
|---|---|---|---|
| JP | 04-117785 | | 4/1992 |
| JP | 05-197357 | | 8/1993 |
| JP | 07-143505 | * | 6/1995 |
| JP | 07-318905 | | 12/1995 |
| JP | 08-179727 | | 7/1996 |
| JP | 09-218668 | * | 8/1997 |

OTHER PUBLICATIONS

Japanese Office Action 10-292280.
Japanese Office Action issued Jul. 3, 2007 in corresponding JP Application No. 10-292280.
Japanese Office Action dated Dec. 25, 2007 for corresponding Japanese Application No. 10-292280.

* cited by examiner

*Primary Examiner*—Alexander Eisen
*Assistant Examiner*—Christopher E Leiby
(74) *Attorney, Agent, or Firm*—Rader, Fishman & Grauer PLLC

(57) ABSTRACT

A liquid-crystal display apparatus free from chrominance non-uniformity. In a liquid-crystal display apparatus with a primary color video signal and a common voltage supplied to a liquid-crystal display panel, a correction signal for canceling the chrominance non-uniformity is superimposed on the primary color video signal.

6 Claims, 9 Drawing Sheets

LIQUID-CRYSTAL DISPLAY APPARATUS AND THREE-PANEL LIQUID-CRYSTAL DISPLAY PROJECTOR

RELATED APPLICATION

This application is a continuation application of Ser. No. 09/417,714 filed Oct. 13, 1999 now abandoned.

BACKGROUND OF THE INVENTION

1. Field of the Invention

The present invention relates to a liquid-crystal display apparatus and a three-panel liquid-crystal display projector.

2. Description of the Related Art

Referring to FIG. 10, a three-panel liquid-crystal display projector employs three liquid-crystal display panels 1R, 1G, and 1B as optical shutters. A high-intensity white light from a metal halide lamp or the like is separated through dichroic mirrors (not shown) or the like into red, green and blue light rays. Receiving the red, green and blue light rays, the respective liquid-crystal display panels 1R, 1G, and 1B output a red video image, a green video image and a blue video image. The red, green, and blue video images are synthesized through a dichroic prism 2, and the synthesized image is then projected onto a screen 4 through a lens system 3. An enlarged projected color image is thus obtained.

Such a three-panel liquid-crystal display projector suffers from on-screen chrominance non-uniformity in the display on the screen 4, because of non-uniformity in light transmissivity in the optical systems 2 and 3, and the liquid-crystal display panels 1R, 1G, and 1B.

In the three-panel liquid-crystal display projector, as shown in FIG. 10, the red video image and the blue video image are respectively left-side-right inverted at each of the dichroic prism 2 and the lens system 3, but the green video image is inverted by the lens system 3 only, and the green video image only is projected in a left-side-right inverted orientation.

Now there is a variation in luminance in a horizontal direction in the light source or the optical systems. The green video signal only is inverted left side right, and the red video image and the blue video image are superimposed on the green video image, as shown in FIG. 11. When a gray color display is presented, the right hand side becomes greenish gray, and the left hand side becomes magenta gray, as shown in FIG. 11. A similar phenomenon occurs when the red video image or the blue video image is inverted.

Another cause for the chrominance non-uniformity on the display screen is a variation in light transmissivity, due to a interlayer gap variation present in the liquid-crystal display panel, called Newton's rings, as shown in FIG. 12.

An electrical signal processing system in the conventional three-panel liquid-crystal display projector is unable to remove the chrominance non-uniformity, because brightness adjustment, gain adjustment and a liquid-crystal display panel common voltage remain fixed throughout a horizontal display period and a vertical display period.

SUMMARY OF THE INVENTION

Accordingly, it is an object of the present invention to remove chrominance non-uniformity.

A liquid-crystal display apparatus of the present invention, supplying a primary color video signal and a common voltage to a liquid-crystal display panel, superimposes a correction signal for canceling chrominance non-uniformity on the primary color video signal or the common voltage.

In accordance with the present invention, the correction signal for canceling the chrominance non-uniformity is superimposed on the primary color video signal or the common voltage, and the non-uniformity is thus removed from the display screen. A color image having a good uniformity is thus presented.

A three-panel liquid-crystal display projector of the present invention includes a liquid-crystal display panel, supplied with a red video signal and a common voltage, for presenting a red video image, a liquid-crystal display panel, supplied with a green video signal and the common voltage, for presenting a green video image, and a liquid-crystal display panel, supplied with a blue video signal and the common voltage, for presenting a blue video image, wherein one of the red, green and blue video images is projected in a left-side-right inverted orientation. In this projector, a chrominance non-uniformity correction signal is superimposed on the video signal which is supplied to the liquid-crystal display panel which projects the left-side-right inverted video image, or a chrominance non-uniformity correction signal is superimposed on the common voltage which is supplied to the liquid-crystal display panel which projects the left-side-right inverted video image.

Since a chrominance non-uniformity correction signal is superimposed on the video signal or the common voltage, which is supplied to the liquid-crystal display panel which projects the left-side-right inverted video image, the non-uniformity is thus removed from the display screen. A color image having a good uniformity is thus presented.

DESCRIPTION OF THE PREFERRED EMBODIMENTS

Figure 1:
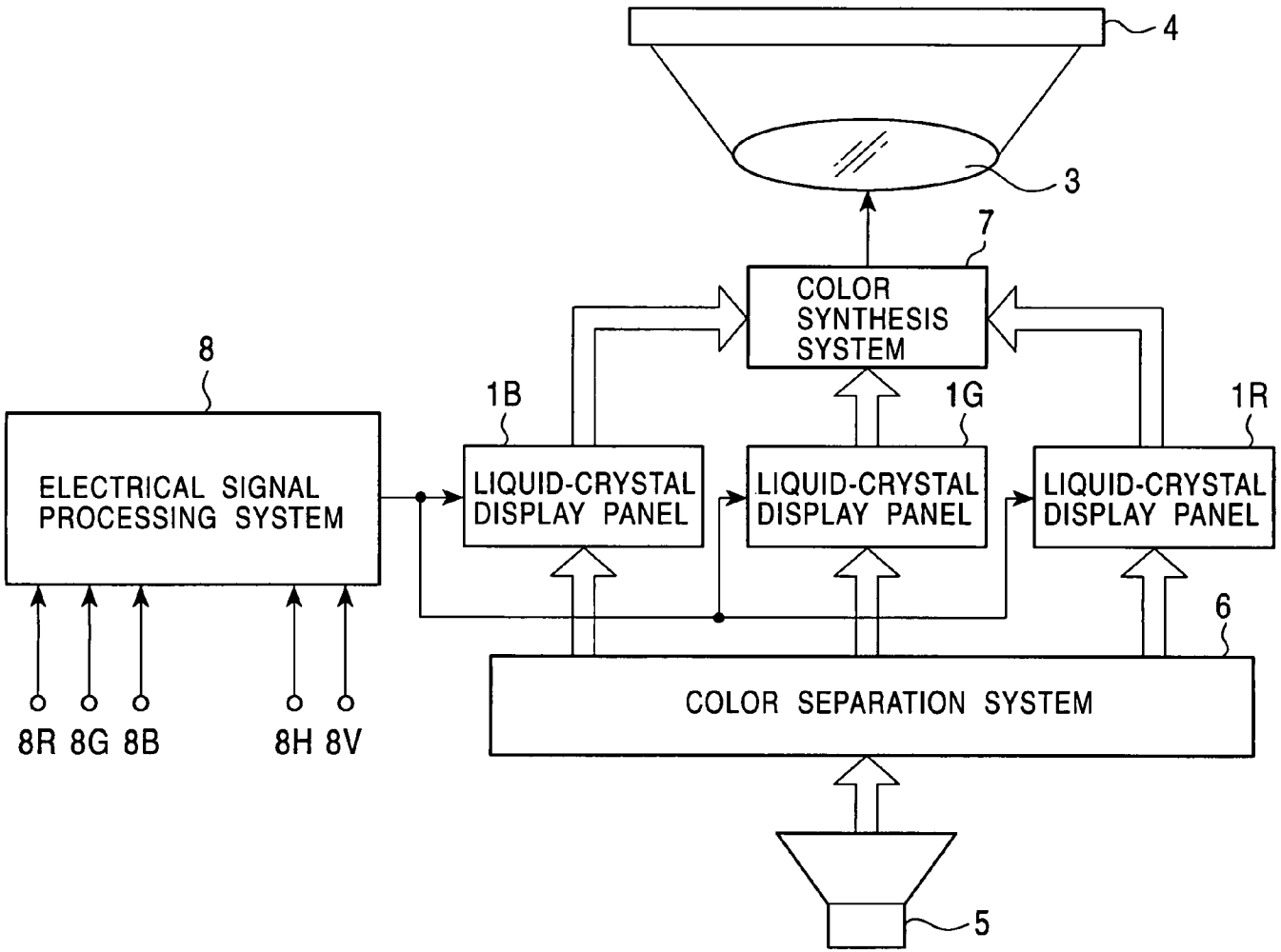
FIG. 1 is a block diagram of a three-panel liquid-crystal display projector.
Figure 10:
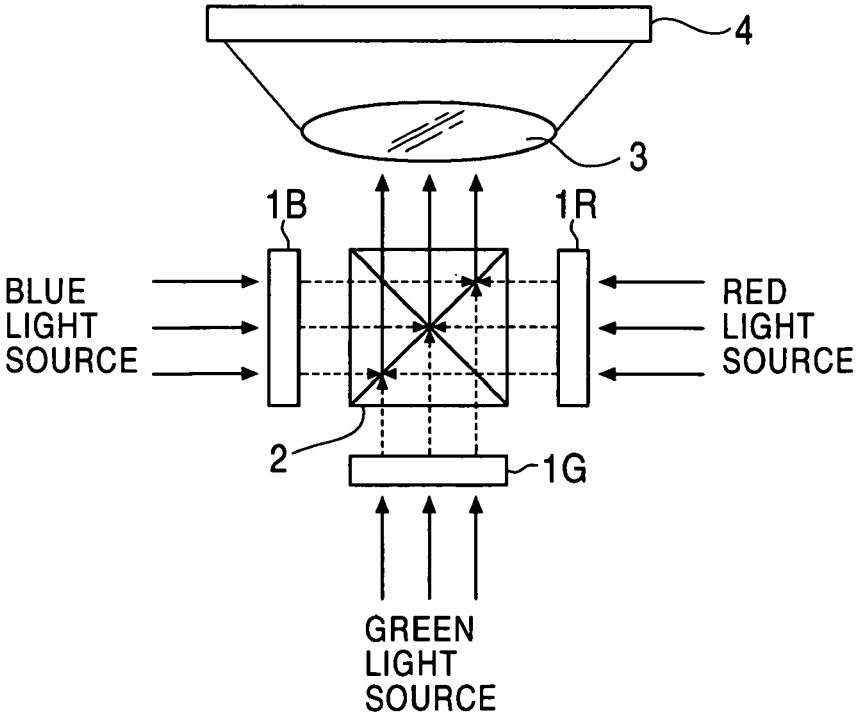
FIG. 10 is a block diagram showing a three-panel liquid-crystal display projector.

One embodiment of the present invention is now discussed, referring to FIG. 1 to FIGS. 7A-7E. Referring to FIG. 1, components identical to those described with reference to FIG. 10 are designated with the same reference numerals. In this embodiment, a liquid-crystal display panel, which projects a video image in a left-side-right inverted orientation, is the liquid-crystal display panel for the green video image.

As shown in FIG. 1, a three-panel liquid-crystal display projector in this embodiment employs three liquid-crystal display panels 1R, 1G, and 1B, as optical shutters. A high-intensity white light from a white light source 5 such as a metal halide lamp is separated through a color separation system 6, such as a dichroic mirror, into red, green, and blue light rays. The red, green, and blue light rays are respectively incident on the liquid-crystal display panels 1R, 1G, and 1B and a red video image, a green video image and a blue video image are thus produced.

The red, green, and blue video images are then synthesized by a color synthesis system 7, such as a dichroic prism, and a synthesized color image is projected onto a screen 4. An enlarged projected image thus appears on the screen 4.

The output signal from an electrical signal processing system 8 is respectively fed to the liquid-crystal display panels 1R, 1G, and 1B.

Figure 2:
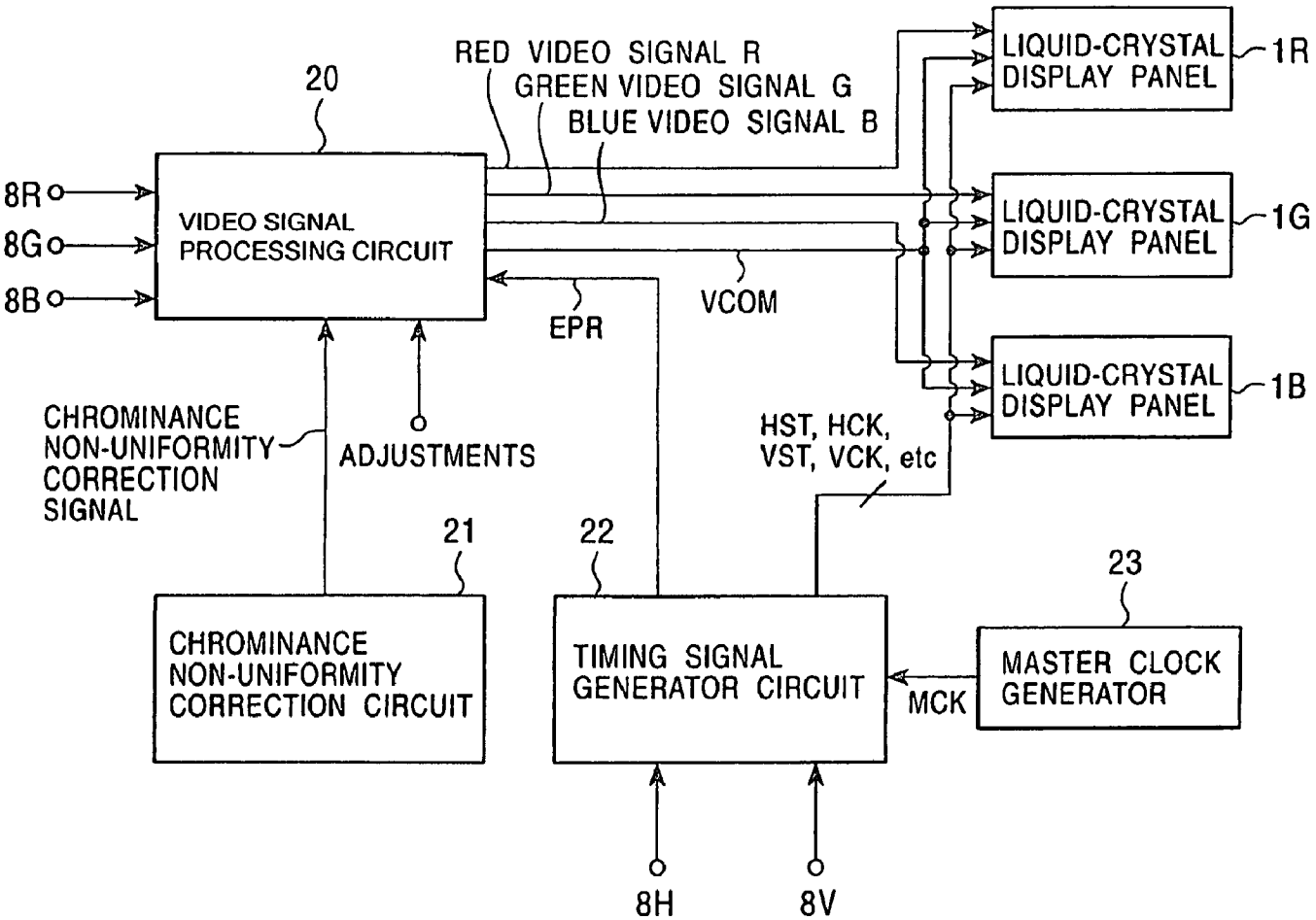
FIG. 2 is a block diagram showing an electrical signal processing system of the present invention.

The electrical signal processing system 8 in this embodiment is constructed as shown in FIG. 2. Referring to FIG. 1 and FIG. 2, there are shown red, green, and blue video signal input terminals 8R, 8G, and 8B for receiving the primary color video signals from a color video reproducing apparatus, a horizontal synchronization signal input terminal 8H, and a vertical synchronization signal input terminal 8V.

In the electrical signal processing system 8 shown in FIG. 2, the red, green, and blue video signals, input to the respective input terminals 8R, 8G, and 8B, are fed to a video signal processing circuit 20 while a chrominance non-uniformity correction signal from a chrominance non-uniformity correction circuit 21 to be described later is input to the video signal processing circuit 20.

Referring to FIG. 2, the horizontal synchronization signal coming in through the horizontal synchronization signal input terminal 8H, as shown in FIG. 4A, is supplied to a timing signal generator circuit 22, while the vertical synchronization signal coming in through the vertical synchronization signal input terminal 8V is supplied to the timing signal generator circuit 22. Furthermore, a master clock MCK from a master clock generator circuit 23 is supplied to the timing signal generator circuit 22.

Referring to FIG. 4B, the timing signal generator circuit 22 produces a phase-inverted signal FRP in a horizontal period, in synchronization with the horizontal synchronization signal, and feeds the phase-inverted signal FRP to the video signal processing circuit 20. In synchronization with the horizontal synchronization signal and the vertical synchronization signal, the timing signal generator circuit 22 produces a horizontal start signal HST, a horizontal clock signal HCK, a vertical start signal VST, a vertical clock signal VCK, and so forth and respectively feeds these signals as drive signals to the liquid-crystal display panels 1R, 1G, and 1B.

Figure 3:
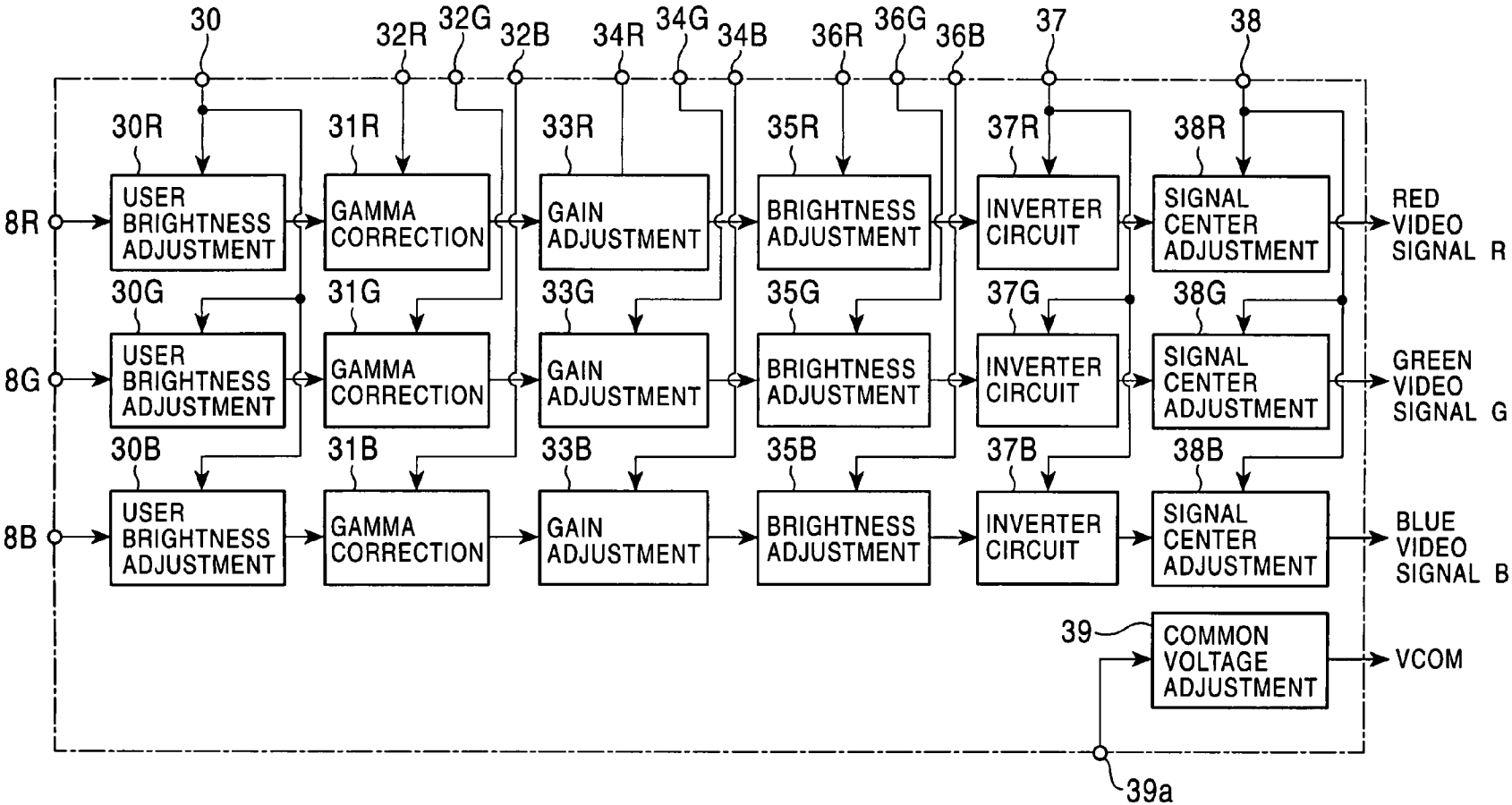
FIG. 3 is a block diagram showing a video signal processing circuit of the present invention.
Figure 4:
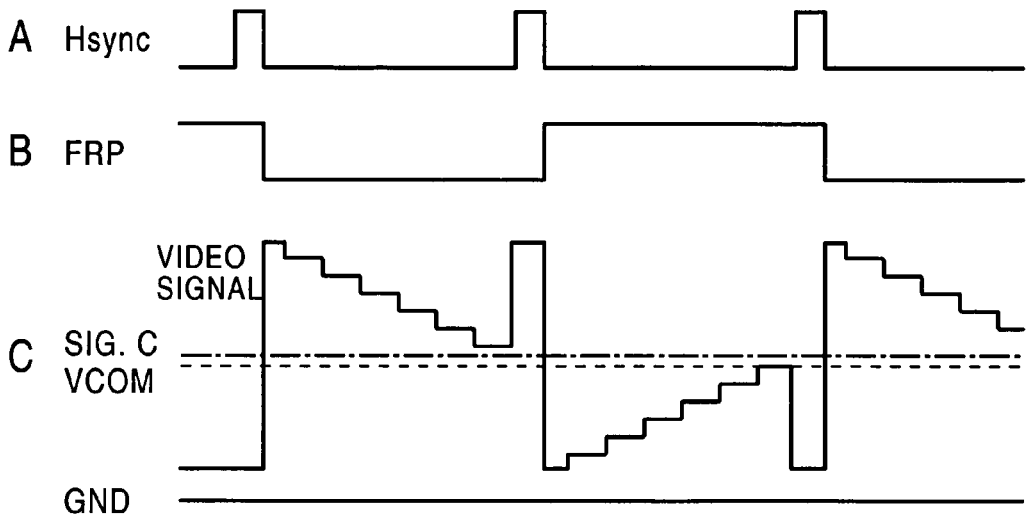
FIGS. 4A-4C are waveform diagrams showing the operation of the three-panel liquid-crystal display projector.

FIG. 3 shows an example of the video signal processing circuit 20. Referring to FIG. 3, the video signal processing circuit 20 is now discussed. In the video signal processing circuit 20, the red, green, and blue video signals, respectively supplied to the input terminals 8R, 8G, and 8B, are sent to user brightness adjustment circuits 30R, 30B, and 30G, by which a user adjusts brightness level. The user brightness adjustment circuits 30R, 30G, and 30B are adjusted in brightness level by a user-controlled adjustment signal at an input terminal 30.

The output signals of the user brightness adjustment circuits 30R, 30G, and 30B, which are subject to user control, are respectively fed to gamma correction circuits 31R, 31G, and 32B. The gamma correction circuits 31R, 31G, and 31B perform gamma correction with correction signals, set at manufacture, at correction signal input terminals 32R, 32G, and 32B.

The gamma-corrected output signals of the gamma correction circuits 31R, 31G, and 31B are respectively fed to gain adjustment circuits 33R, 33G, and 33B. The gain adjustment circuits 33R, 33G, and 33B perform gain adjustment in accordance with adjustment signals supplied at adjustment signal input terminals 34R, 34G, and 34B.

The gain-adjusted output signals of the gain adjustment circuits 33R, 33G, and 33B are respectively fed to brightness adjustment circuits 35R, 35G, and 35B. The brightness adjustment circuits 35R, 35G, and 35B perform brightness adjustment in accordance with adjustment signals respectively supplied at adjustment signal input terminals 36R, 36G, and 36B.

In this embodiment, chrominance non-uniformity correction signals are respectively fed to the brightness adjustment circuits 35R, 35G, and 35B to cancel chrominance non-uniformity, as will be described later.

The brightness adjustment circuits 35R, 35G, and 35B adjust a direct-current component with respect to a signal center SIG. C in the video signal which is alternately inverted every horizontal period, as seen in FIG. 4C.

The brightness-adjusted output signals of the brightness adjustment circuits 35R, 35G, and 35B are respectively fed to signal center adjustment circuits 38R, 38G, and 38B via inverter circuits 37R, 37G, and 37B. Referring to FIG. 4C, the inverter circuits 37R, 37G, and 37B alternately phase-invert the red, green, and blue video signals every horizontal period in response to the phase-inverted signal FRP in synchronization with the horizontal synchronization signal which is fed to an inverting signal input terminal 37 as shown in FIG. 4B.

In response to a signal center adjustment signal coming in through a signal center adjustment signal terminal 38, the signal center adjustment circuits 38R, 38G, and 38B adjust the signal centers SIG. C of the video signals which are alternately phase-inverted every horizontal period as shown in FIG. 4C. The red, green, and blue video signals, appearing on the outputs of the signal center adjustment circuits 38R, 38G, and 38B, are then respectively fed to the liquid-crystal display panels 1R, 1G, and 1B.

Referring to FIG. 3, the video signal processing circuit 20 includes a common voltage adjustment circuit 39. The common voltage adjustment circuit 39 adjusts a common voltage VCOM, as shown in FIG. 4C, in accordance with a common voltage adjustment signal coming in through a common voltage adjustment signal input terminal 39*a*. The common voltage adjustment circuit 39 outputs the common voltage VCOM to the liquid-crystal display panels 1R, 1G, and 1B.

Actually applied to the liquid-crystal display panels 1R, 1G, and 1B are differences between the red, green, and blue video signals and the common voltage VCOM, as shown in FIG. 4C. To remove the chrominance non-uniformity, a voltage change for cancelling the chrominance non-uniformity is applied to the red, green, and blue video signals or to the common voltage VCOM.

Figure 5:
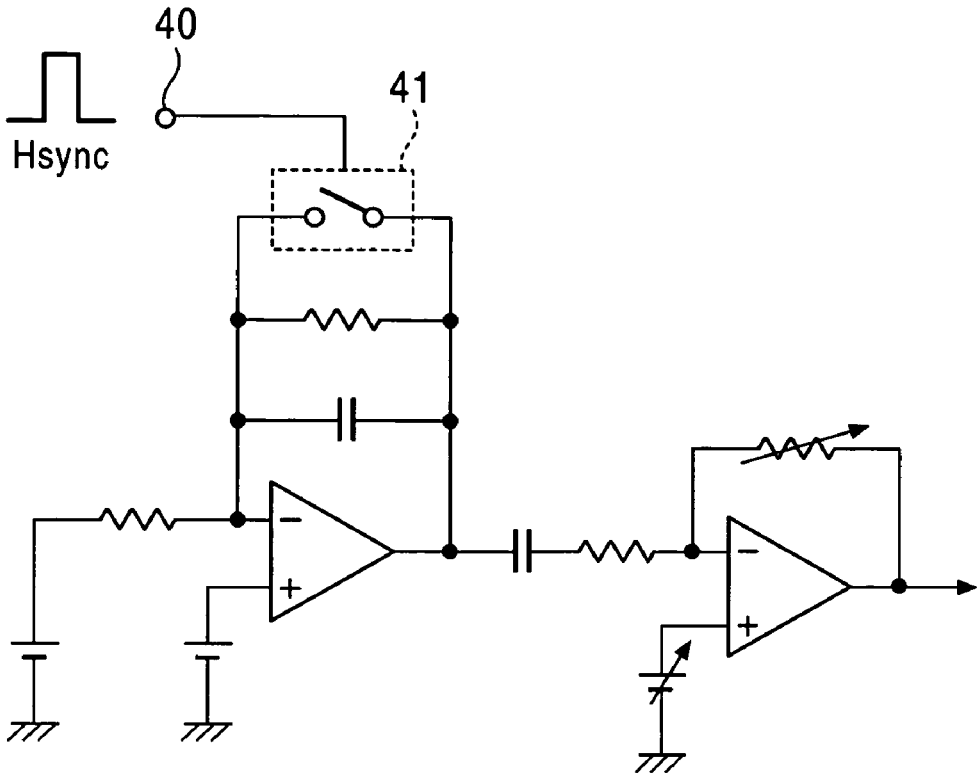
FIG. 5 is a circuit diagram showing a sawtooth wave generator circuit.
Figure 6:
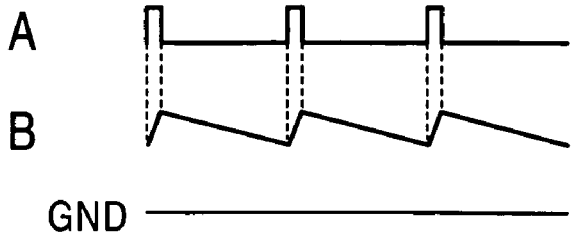
FIGS. 6A-6B are waveform diagrams showing the operation of the circuit shown in FIG. 5.
Figure 7:
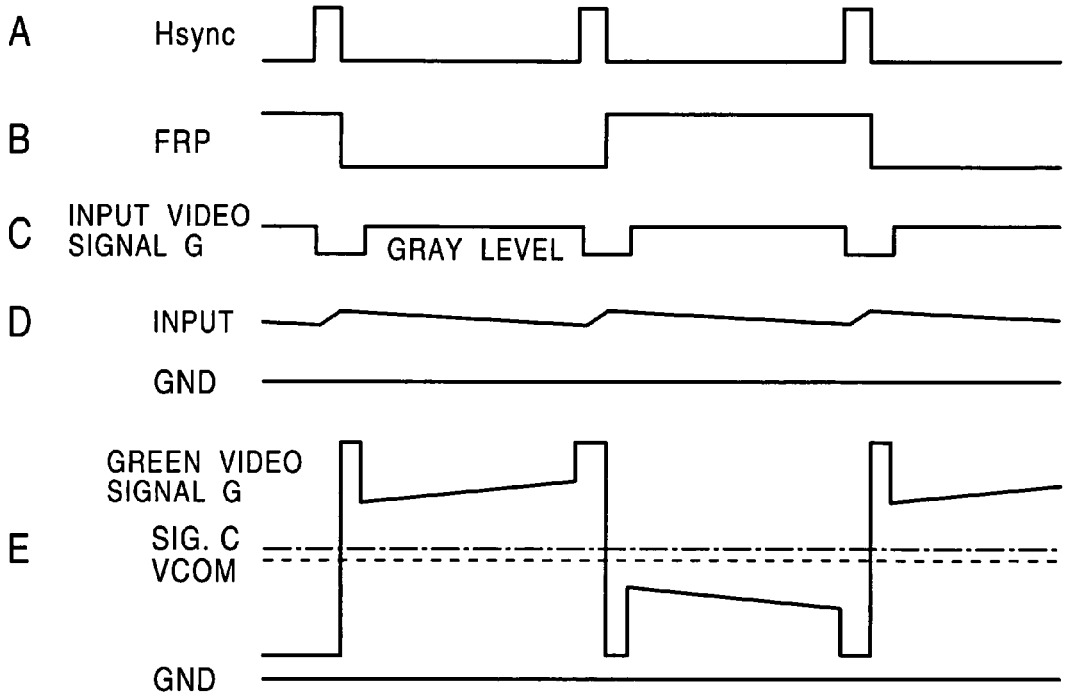
FIGS. 7A-7E are waveform diagrams showing one operational example of the present invention.
Figure 11:
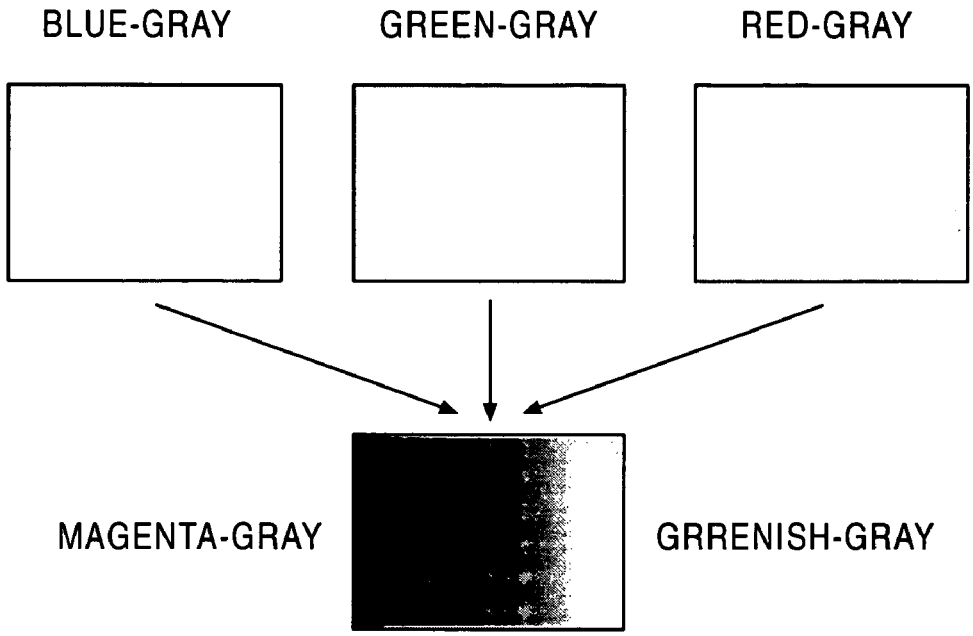
FIG. 11 depicts diagrams showing chrominance non-uniformity.
Figure 12:
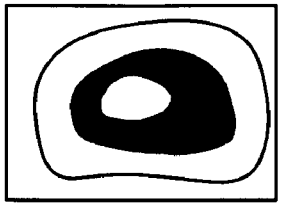
FIG. 12 is a diagram showing another example of chrominance non-uniformity.

For example, to remove chrominance non-uniformity that linearly varies in a horizontal direction as shown in FIG. 11, a sawtooth wave generator circuit for generating a sawtooth wave in the horizontal period is arranged as a chrominance non-uniformity correction circuit 21 as shown in FIG. 5.

FIG. 6A shows a horizontal pulse having a predetermined pulse width in the horizontal period, which is supplied at an input terminal 40 in synchronization with the horizontal synchronization signal as shown in FIG. 5. When an analog switch 41 is turned on and off by the horizontal pulse, a sawtooth wave signal having the horizontal period appears on an output terminal as shown in FIG. 6B.

In this embodiment, the sawtooth wave signal in the horizontal period, produced in the chrominance non-uniformity correction circuit 21, is supplied to the brightness adjustment signal input terminal 36G connected to the brightness adjustment circuit 35G which adjusts the green video signal.

The operation of the electrical signal processing system 8 is now discussed, referring to FIGS. 7A through 7E. The gray-level red, green, and blue video signals, shown in FIG. 7C, are respectively fed to the input terminals 8R, 8G, and 8B, while the sawtooth wave signal in the horizontal period, shown in FIG. 7D, is fed to the brightness adjustment signal input terminal 36G as the chrominance non-uniformity correction signal, and the phase-inverted signal FRP, shown in FIG. 7B, is fed to the phase-inverted signal input terminal 37.

The signal center adjustment circuit 38G outputs the green video signal, in which the horizontal sawtooth wave signal for chrominance non-uniformity correction is superimposed on the gray-level green video signal as shown in FIG. 7E. The red video image, green video image, and blue video image presented by the liquid-crystal display panels 1R, 1G, and 1B are synthesized and then projected onto the screen 4. The chrominance non-uniformity linearly varying in the horizontal direction is then canceled, and a color image (gray) having a good uniformity thus results. FIG. 7A shows the horizontal synchronization signal.

In the above discussion, the chrominance non-uniformity linearly varying in the horizontal direction is canceled. Chrominance non-uniformity linearly varying in a vertical direction may be also equally canceled.

Figure 9:
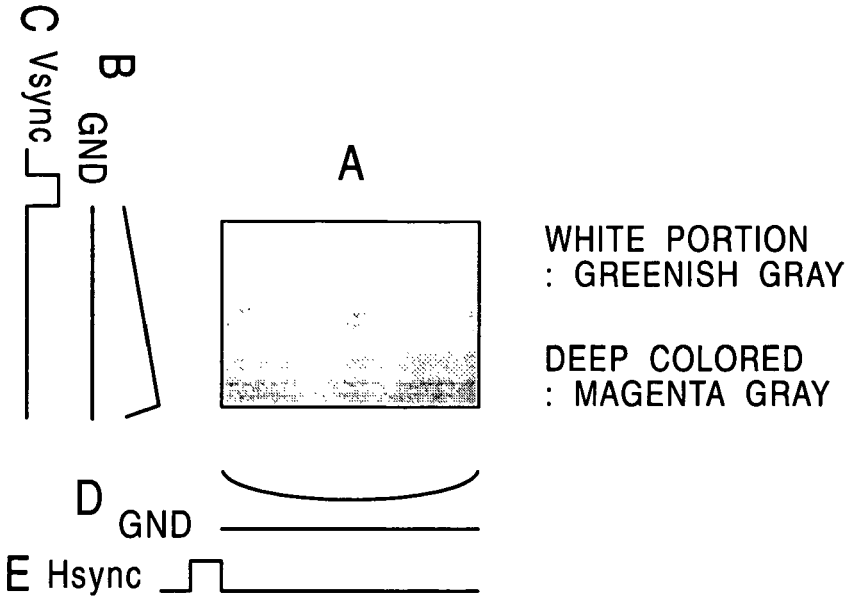
FIGS. 9A-9E are diagrams showing the operation of the present invention.

In the above discussion, the chrominance non-uniformity that linearly varies is canceled. Chrominance non-uniformity appearing on both end portions in a horizontal direction and on a lower portion in a vertical direction, as shown in FIG. 9A, may also be canceled. Specifically, in connection with a vertical direction, a sawtooth wave signal in the vertical period is produced as a chrominance non-uniformity correction signal as shown in FIG. 9B, and in connection with a horizontal direction, a parabolic wave signal in the horizontal period is produced as a chrominance non-uniformity correction signal as shown in FIG. 9D. These signals are combined and then applied to the brightness adjustment signal input terminal 36G, and the chrominance non-uniformity shown in FIG. 9A is canceled.

Referring to FIG. 9A, a white portion is greenish gray, and a deep-colored portion is magenta gray. FIG. 9C shows a vertical synchronization signal, and FIG. 9E shows a horizontal synchronization signal.

The chrominance non-uniformity correction circuit 21 may also produce a chrominance non-uniformity correction signal as follows. The three-panel liquid-crystal display projector projects an all-gray display onto the screen 4, the display appearing on the screen is captured into a field memory using an image pickup device such as a charge-coupled device camera, and a chrominance non-uniformity correction signal is produced based on information captured into the field memory.

This method removes chrominance non-uniformity due to variations in the entire three-panel liquid-crystal display projectors.

In the above discussion, the chrominance non-uniformity signal is superimposed on the red, green, and blue video signals. Alternatively, the chrominance non-uniformity signal may be superimposed on the common voltage supplied to the liquid-crystal display panels 1R, 1G, and 1B. In this case, however, unlike the above embodiment, the liquid-crystal display panels 1R, 1G, and 1B need their respective common voltage adjustment circuits to independently adjust the common voltages.

Figure 8:
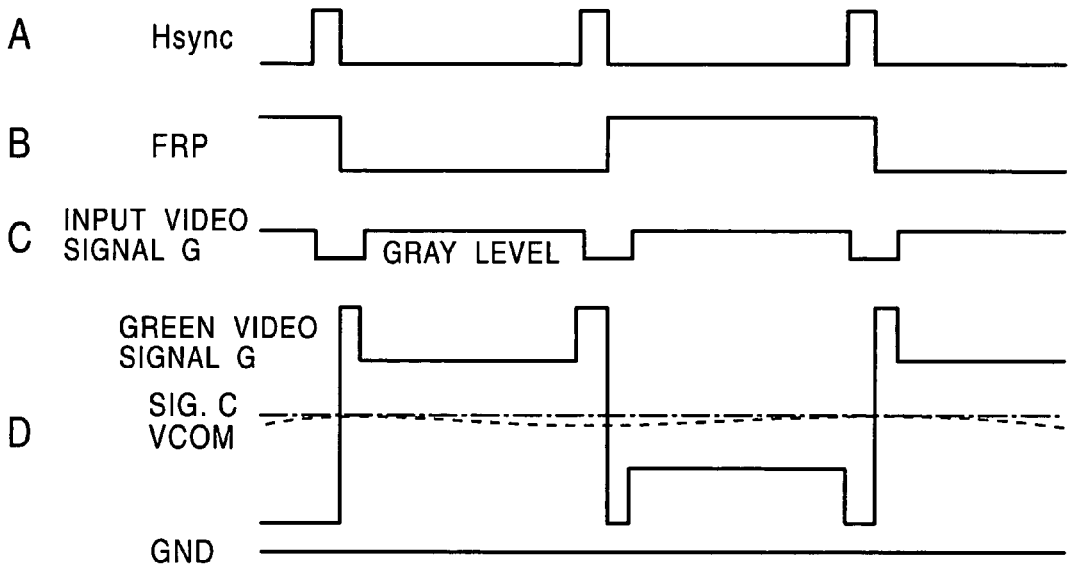
FIGS. 8A-8D are waveform diagrams showing another operational example of the present invention.

To correct chrominance non-uniformity linearly varying in a horizontal direction as shown in FIG. 11, a triangular wave signal spreading in a horizontal period is formed as a chrominance non-uniformity correction signal as represented by a dotted line in FIG. 8D. The horizontal triangular wave signal is superimposed onto the common signal VCOM which is supplied to the liquid-crystal display panel 1G, to which the green video signal is fed. The rest of the construction remains unchanged from the above embodiment.

The chrominance non-uniformity linearly varying in a horizontal direction is thus canceled. FIG. 8A shows a horizontal synchronization signal, FIG. 8B shows a phase-inverted signal FRP in a horizontal period, FIG. 8C shows a gray-level green video signal supplied at the input terminal 8G, and FIG. 8D shows a green video signal appearing on the output of the signal center adjustment circuit 38G.

The present invention is not limited to the above embodiments, and various modifications are possible without departing from the scope and spirit of the present invention. For example, the red video liquid-crystal display panel or the blue video liquid-crystal display panel, rather than the green video liquid-crystal display panel, may project an image in a left-side right inverted orientation.

In accordance with the present invention, the chrominance non-uniformity correction signal is superimposed onto the primary color video signal or the common voltage, supplied to the liquid-crystal display panel, the chrominance non-uniformity is canceled on the display screen, and a color image with an excellent uniformity thus results.

What is claimed is:

1. A liquid-crystal display apparatus comprising:

a common voltage adjustment circuit adapted to adjust a common voltage;

a chrominance non-uniformity correction circuit adapted to generate a chrominance non-uniformity correction signal, said chrominance non-uniformity correction signal being superimposable onto said common voltage or said primary color video signal;

a display panel adapted to receive said common voltage and a primary color video signal, a difference between said common voltage and said primary color video signal being applied to said display panel, wherein said chrominance non-uniformity correction signal is superimposed onto said common voltage.

2. A liquid-crystal display apparatus according to claim 1, wherein a brightness adjustment circuit is adapted to adjust a brightness of said primary color video signal in response to said chrominance non-uniformity correction signal.

3. A liquid-crystal display apparatus according to claim 1, wherein said primary color video signal is one of a red video signal, a green video signal, and a blue video signal.

4. A liquid-crystal display apparatus according to claim 1, wherein said chrominance non-uniformity correction signal is superimposed onto said primary color video signal.

5. A liquid-crystal display apparatus according to claim 4, wherein a brightness adjustment circuit is adapted to adjust a brightness of said primary color video signal in response to said chrominance non-uniformity correction signal.

6. A liquid-crystal display apparatus according to claim 1, wherein said chrominance non-uniformity correction signal is a sawtooth wave signal.

* * * * *